US011465893B2

(12) United States Patent
Ferreira et al.

(10) Patent No.: US 11,465,893 B2
(45) Date of Patent: Oct. 11, 2022

(54) VALVE AND METHOD FOR GASIFYING LIQUIDS AND DISPENSING GASIFIED LIQUIDS

(71) Applicant: Heber Frizera Ferreira, Assis Chateaubriand (BR)

(72) Inventors: Heber Frizera Ferreira, Assis Chateaubriand (BR); Flavio Henn Ferreira, Sao Paulo (BR); Rodrigo Cesar Dos Santos, Santo Andre (BR); Walter Lebante, Santo Andre (BR); Ana Lucia Domingues De Oliveira, Santo Andre (BR)

(73) Assignee: HEBER FRIZERA FERREIRA, Chateaubriand (BR)

( * ) Notice: Subject to any disclaimer, the term of this patent is extended or adjusted under 35 U.S.C. 154(b) by 25 days.

(21) Appl. No.: 16/957,266

(22) PCT Filed: Dec. 17, 2018

(86) PCT No.: PCT/BR2018/050466
§ 371 (c)(1),
(2) Date: Jun. 23, 2020

(87) PCT Pub. No.: WO2019/126850
PCT Pub. Date: Jul. 4, 2019

(65) Prior Publication Data

US 2021/0061636 A1 Mar. 4, 2021

(30) Foreign Application Priority Data

Dec. 28, 2017 (BR) ..... 1020170285405

(51) Int. Cl.
*B67D 1/00* (2006.01)
*B67D 1/14* (2006.01)

(52) U.S. Cl.
CPC ..... *B67D 1/0071* (2013.01); *B67D 1/1405* (2013.01)

(58) Field of Classification Search
CPC .... B67D 1/0418; B67D 3/041; B67D 1/0071; B67D 1/1405; B67D 1/08
(Continued)

(56) References Cited

U.S. PATENT DOCUMENTS 4,305,421 A 12/1981 Fallon
5,979,713 A * 11/1999 Grill ..... B67D 1/1405 222/399
(Continued)

FOREIGN PATENT DOCUMENTS

BR 102014025747-0 A2 5/2016
WO 2016/026694 2/2016
WO 2016/159795 A1 10/2016

OTHER PUBLICATIONS

PCT International Search Report dated Jul. 3, 2019, Application No. PCT/BR2018/050466.

*Primary Examiner* — Vishal Pancholi
*Assistant Examiner* — Robert K Nichols, II
(74) *Attorney, Agent, or Firm* — The Dobrusin Law Firm, P.C.

(57) ABSTRACT

This invention relates to a valve for gasifying liquids and dispensing gasified liquids, comprising a main body (7) which comprises an air valve (3) interconnected to an inner channel (3*a*), said valve consisting of a nozzle which comprises a universal thread (10) and a cylindrical piece (11*a*) which connects through means of connection to a reductant (4), and this reductant (4) connecting to a liquid outlet pipe (5), said reductant (4) connects to a flexible hose (6) arranged "in L" which is internally positioned to the tubular extension (2), said flexible hose (6) is arranged between the main body (7) and a handle (1) which pivots with the main
(Continued)

body (7) through metallic rod (9*c*), said pipe (5) comprises another reductant (41). In particular, said valve is compatible with the nozzle of any bottle or growler with the universal thread and it allows gasifying and dispensing with flow control and controlled generation of foam in gasified liquids, such as chopp, sparkling wine, among others in locations other than those the gasification occurred.

6 Claims, 6 Drawing Sheets

(58) Field of Classification Search
USPC ..... 222/399, 153.01, 505
See application file for complete search history.

(56) References Cited

U.S. PATENT DOCUMENTS

| | | | | |
|---|---|---|---|---|
| 8,191,740 | B2 * | 6/2012 | Hoss | B67D 1/0418<br>222/399 |
| 9,533,865 | B2 | 1/2017 | Sonnichsen | |
| 2013/0233878 | A1 | 9/2013 | Lindmayer | |
| 2013/0233895 | A1 | 9/2013 | Johannes | |
| 2015/0274501 | A1 | 10/2015 | Lehman | |
| 2017/0267510 | A1 * | 9/2017 | Chapman | B67D 1/1438 |
| 2017/0275147 | A1 | 9/2017 | Moezidis | |

* cited by examiner

FIG. 3A
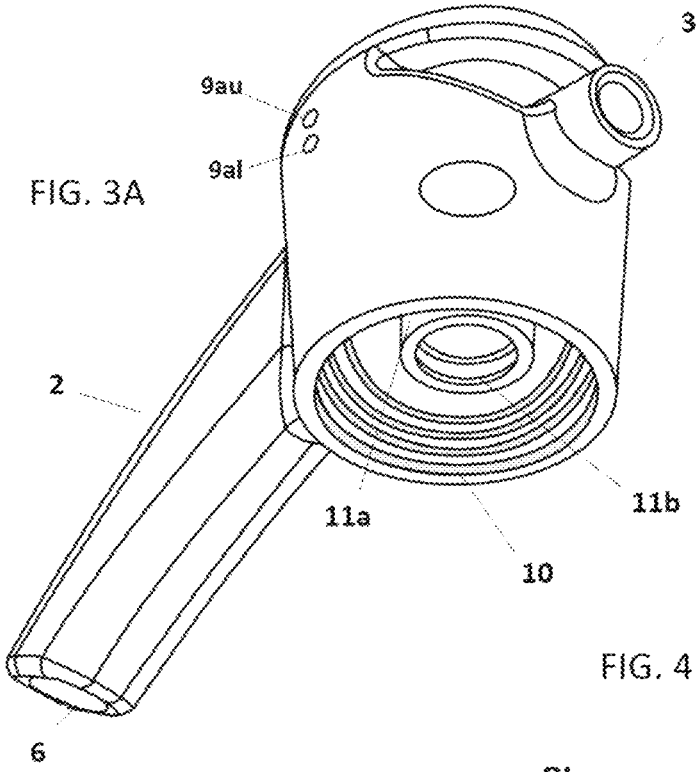
FIG. 3B
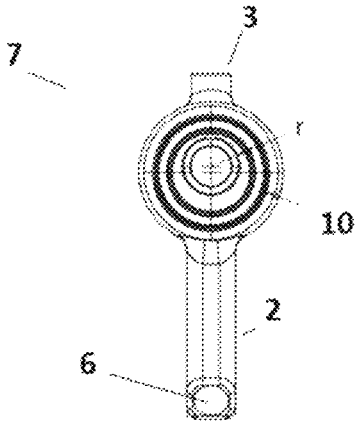
FIG. 4
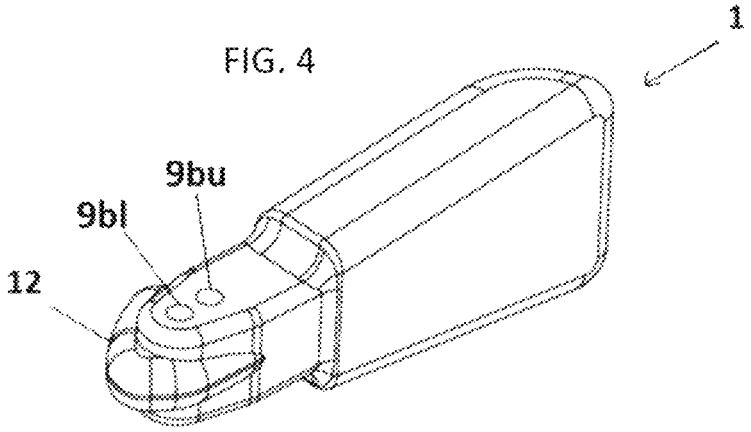
FIG. 5A
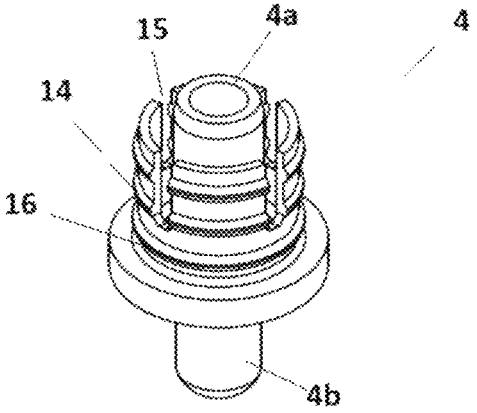
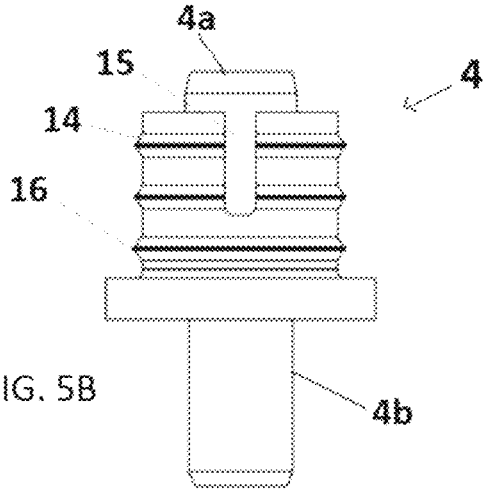
FIG. 5B

VALVE AND METHOD FOR GASIFYING LIQUIDS AND DISPENSING GASIFIED LIQUIDS

FIELD OF THE INVENTION

This invention relates to valves for dispensing liquid. In particular, this invention relates to a valve for dispensing gasified liquid. In particular, one of the uses of said valve is coupled with small, portable packaging.

BACKGROUND OF THE INVENTION

Currently, existing devices for storing and dispensing gasified beverages, especially alcoholic beverages such as chopp, in smaller containers have been largely highlighting because they provide a new form of consumption, with portability as their large differential. These containers are commonly called as "growlers" and are generally glass, ceramic or plastic and have the advantage of enabling transport of the gasified beverage to the location chosen by the user. Thus, the user who consumes the chopp is not limited to the location serving the chopp, a bar, restaurant, or other type of commercial establishment, but the user may, for example, consume the beverage in a camping or even at high sea during fishing.

However, although such containers enable transport, they still do not ensure perfectly taking the beverage, since they do not prevent loss of gas over time. Thus, the sensory quality of the beverage is lost over time due to de-carbonation and the shape and consistency of the chopp foam taken by such containers in most times is not the same as when the beverage is taken by a bar practitioner.

It is well-known that the relevance of the foam to the consumer of chopp or other type of beverage and current growlers does not allow taking the quality foam.

In a system for taking "balanced" beer, the beer is served with dissolved gas levels near the levels in which it has been produced, that is, its sensory quality is not compromised by taking it.

In this regard, growlers available in the market have not solved this challenge: they are used only as containers with no aggregate functionality. There are still great technical challenges to overcome, some of them: the sealing, an efficient process of gasification, the maintenance of the gasification of the beverage over time, customization of the creamy of the beverage, giving the consumer the possibility of choosing the quantity of foam and liquid to be served, exposing the beverage to air, which accelerates its degradation, and is of possible use only at room pressure.

The patent literature provides some relevant documents which will be described below.

The document BR102014025747-0 refers to a valve for dispensing gasified liquids such as beverages, comprising an inlet nozzle for gasifying the beverage. Said valve comprises a duct that remains immersed in the liquid and a screw that may be a universal thread. Said valve differs from the valve according to this invention, in which it does not comprise a control device of the beverage dispensing mode and sealing devices that decrease the pressure of solubilized gas in the liquid, as well as the customized and controlled generation of foam.

The document US 2015/0274501 refers to a valve for growlers having a pressure relief valve, a gas load location and an immersion pipe in the beverage. Said valve differs from the valve according to this invention, in which it does not comprise or suggest a reducing device according to this invention that reduces the pressure of the liquid as it passes through the pipe at the time of dispensing thereof, nor a mechanism for gasification/injection of gas into the container that allows reuse of the apparatus.

The document WO 2016/159795 describes a valve for packages containing carbonated beverages that comprises a manual lever device to be driven by the user and a pressure reductant positioned at the liquid outlet. Said valve differs from this invention, in which it does not comprise a device for the gasifying the beverage that allows for reuse of the apparatus, and is, unlike this invention, a valve that does not have high efficiency in carbonation, since the container must already contain the gasified liquid, and not the liquid to be gasified according to this invention, and it does not comprise or suggest a reducing device as according to this invention that reduces the pressure of the liquid as it passes through the pipe at the time of dispensing thereof.

The document WO 2016/026694 refers to a valve for dispensing an alcoholic beverage comprising a 2-gear system that operate jointly and whose beverage delivery mechanism is carried out by turning it. It differs from this invention in which it does not comprise a handle with a twist of 60°, reducing or a device gasifying the beverage.

The document U.S. Pat. No. 9,533,865B2 refers to a device for dispensing beer comprising in a single apparatus a beverage carbonation device and a dispensing mechanism, including a liquid internal level display device. The beverage dispensing mechanism can eventually be detached from the container and used alone. However, it differs from this invention in which even detached from the device, it does not comprise a locking mechanism of the new container as according to this invention or a mechanism that allows for easy injection of gas into the container that allows reuse of the apparatus.

The documents US 2013/0233878 and US 2013/0233895 describe a valve for dispensing carbonated beverage comprising a handle whose movement in approximately 90° allows for the release of the beverage. Such valves differ from this invention in which it does not comprise pressure reductants positioned in the beverage outlet path, nor a mechanism for gasifying/injecting gas into the container that allows reuse of the apparatus.

SUMMARY

In view of the foregoing, the inventors of this invention have developed a valve that allows for the perfect dispensing the chopp and the consequent formation of the customized foam at the location where the consumer is, either inside the home or, for example, at the top of a mountain.

This invention comprises a valve comprising a handle (1) which pivots with a main body (7) which comprises an air valve (3), type of Schrader valve, for the insertion of gas, said main body comprising an internal thread (10) compatible with the nozzle of the growler or the container where the beverage is to be gasified, wherein concentric to this nozzle is a cylinder (11*a*) and (11*b*) which connects with a reductant (4) that simultaneously connects to a flexible hose arranged "in L" (6) and a liquid outlet pipe (5) which comes in direct contact with the liquid and the lower end of which comprises another reductant (41) wherein the other end of the flexible hose arranged in "L" (6) is positioned at the end of the extension (2) by where the liquid is dispensed.

Said air valve (3) operates in conjunction with the $CO_2$ or $N_2$ gas cylinder, or a mixture thereof, which gasifies the beverage. After gasification, the valve is disconnected from the gas system.

In particular, the valve according to this invention provides a universal screw which enables the fitting in any type of nozzle of the growler or the container with a universal screw containing the beverage.

In particular, the valve according to this invention comprises the use of a nozzle for the insertion of gas, known as Schrader valve, which is used in a tubeless automobile tire, which ensures the preservation of gasification of the beverage even after several days of its packaging, allowing a good quality of the chopp taken after several days.

In particular, a good taken beverage may be obtained after more than 30 days of its gasification in the growler.

The valve according to this invention allows customization of the foam by the user. The well-known "head" of the beverage may be less or more robust as the taste of the user.

The invention disclosed herein acts in the solution of these technological challenges, since both allows consumption to occur under the condition of the freshly-gasified beverage, and allows portability of the consumption of the gasified beverage maintaining the sensory quality of the beverage more efficiently than existing devices commercially available today.

The valve of this invention may be used in any type of container, either in the portable containers or in fixed containers.

Said valve is useful in dispensing any gasified liquid such as sparkling wine, sparkling water, fizzy juice, soft drink, chopp, beer, among other liquids of interest as well as mixing thereof.

Said valve further has a locking mechanism that allows for the transport of the container safely and properly without the need for decoupling the valve to the container.

This invention further comprises a process for dispensing gasified liquid comprising the use of said valve.

This invention has the advantage of the possibility of making easy the gas injection without the need for pressurizers, in addition to the possibility of reusing the apparatus, valve and container, and the fact that it is low cost, potentially disposable.

BRIEF DESCRIPTION OF THE FIGURES

To complement the description of the invention in order to provide a better understanding of the purpose, the figures mentioned throughout the specification will be described below.

FIGS. 2A-B show the top side view of the main body (7).

FIG. 3A shows the bottom side view of the main body of the valve (7) showing a nozzle comprising an internal thread (10) compatible with the thread of the growler or container wherein the beverage is stored and concentric with the nozzle a cylindrical piece (11*a*) whose inner wall (11*b*) comprises a thread (11*b*) compatible with the reductant (4). FIG. 3B shows the bottom view of this nozzle.

FIG. 4 shows a handle (1) which comprises a semi-ball (12) at one of the ends and 2-holes (9*bu*, 9*bl*) which are compatible with the holes (9*au*, 9*al*) of the main body (7) of the valve.

FIG. 5A shows the top side view of the reductant (4) which comprises an upper cylindrical inner piece in which the flexible hose is connected in "L" and a lower inner cylindrical piece connecting the inner pipe (5). Externally the reductant comprises a screw with grooves and rubber rings for sealing. This outer thread connects with the inner thread (11*b*) of the cylindrical piece concentric to the nozzle. FIG. 5B shows the side view of the reductant.

In general, FIG. 9 shows the valve according to this invention positioned on the nozzle of the container containing the pressurized liquid in which

DETAILED DESCRIPTION OF THE INVENTION

Figure 1:
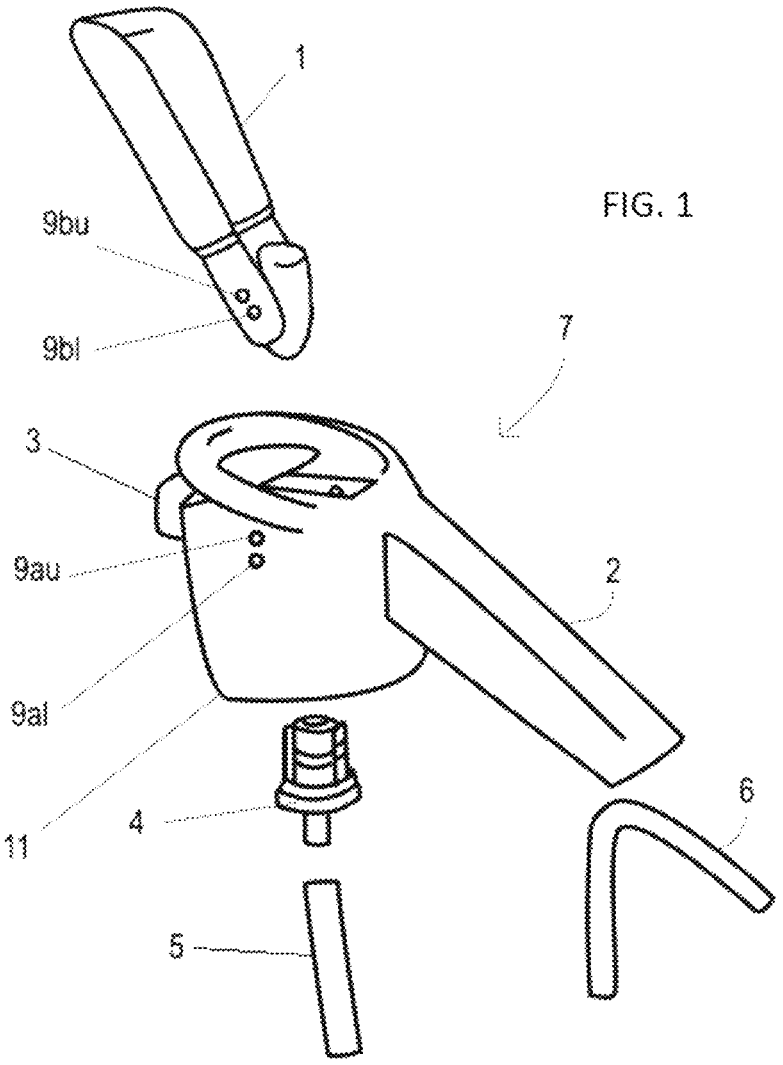
FIG. 1 shows the exploded view of the components of the valve comprising a handle (1) which pivots with a main body (7) which comprises an extension (2) into which is a flexible hose (6) positioned at "L" in which one of the ends is free and the other is connected to the reductant (4) which is connected to the inner pipe (5).
Figure 2A:
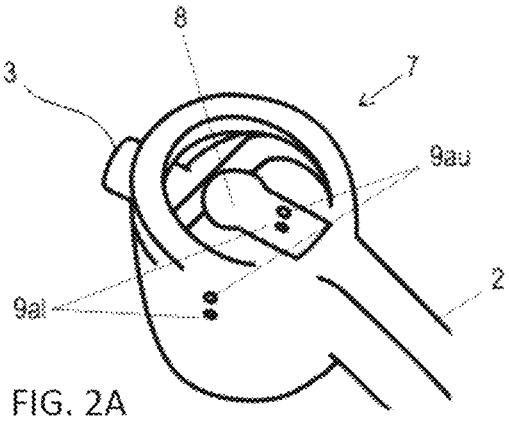
FIG. 2A shows the top view of the main body of the valve (7) showing the hollow semi-ball (8) where it engages the handle (1), 2-holes (9*au*, 9*al*) which are fitted with metallic rods (9*d*, 9*c*) that allow the pivot of the handle with the main body and the locking of the valve respectively, a Schrader air valve (3) and the extension of the valve body (2) by where the gasified liquid is poured.
Figure 2B:
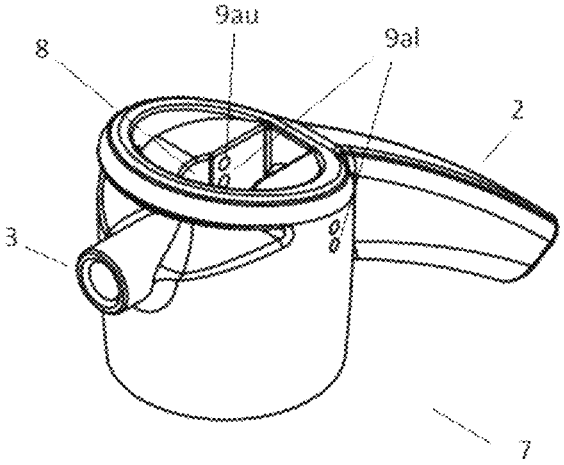
Figure 6:
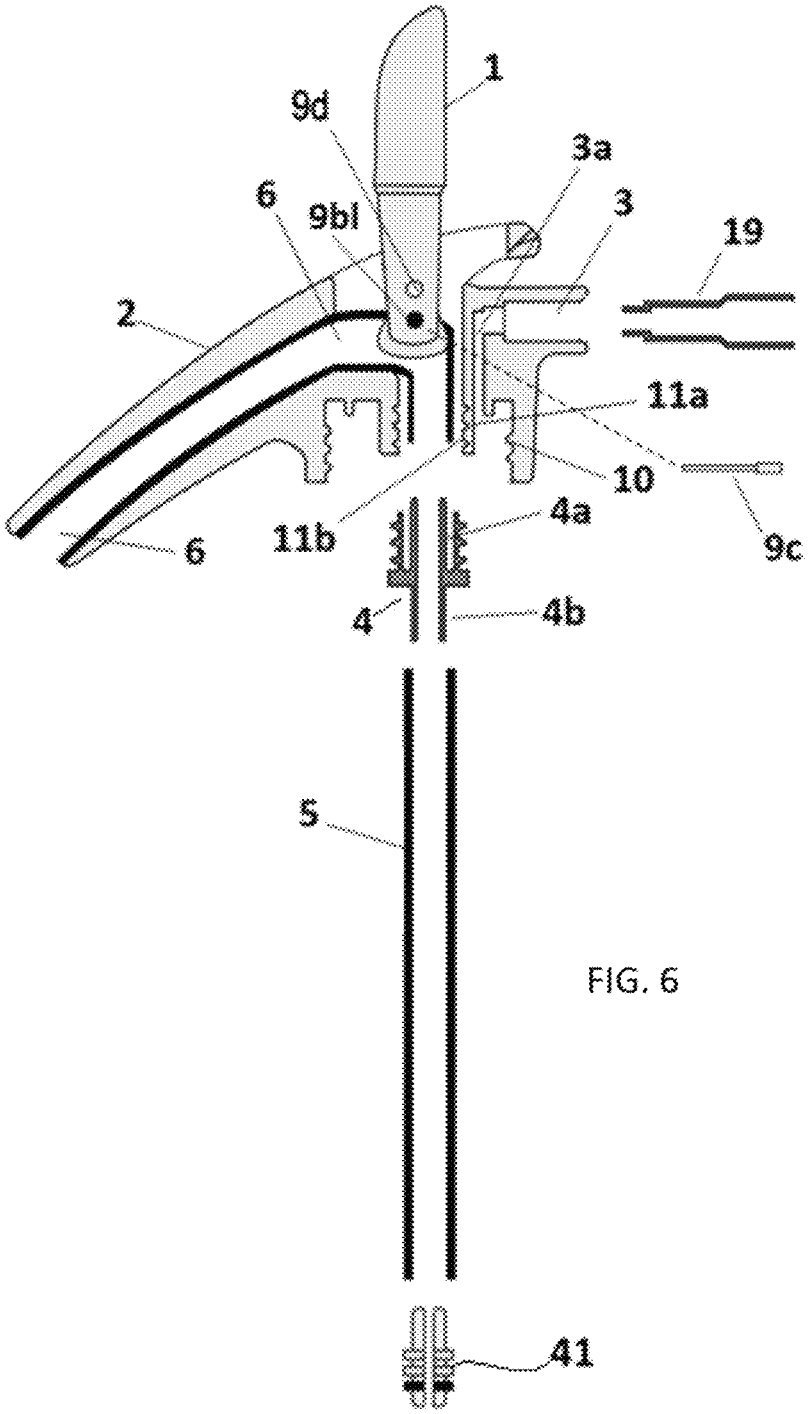
FIG. 6 shows an exploded cross-sectional view of portion of the valve elements according to this invention with special attention on the fitting of the reductant (4) to the cylindrical piece of the nozzle in the inner thread; the second metallic rod (9*c*) passing through the lower hole (9*bl*) of the handle (1); the position of the handle (1) on the flexible hose (6) in "L" so that as the position of the handle (1) is modulated the inner volume of the hose (6); the screw which is compatible with the nozzle of the bottle containing the liquid to be pressurized; the Schrader air valve (3) which conducts the gas through an inner channel (3*a*).

This invention may be embodied based on the following elements, wherein the examples presented herein constitute only examples of the embodiment of the invention without, however, excluding other possible and potentially not described herein but are within the scope of this invention.

The parts of said valve described herein may be manufactured from several materials such as polypropylene plastic or other possible as well as the combination thereof.

The principle of functioning of said valve is based on the fact that the handle (1) comprises a flexible hose (6) positioned internally in the form of "L", wherein such compression occurs at different positions of the handle (1) in a twist of about 60° on the flexible hose (6) generating different inner volumes in the flexible hose (6). For this operation, the upper hole (9*au*) must be filled with the metallic rod (9*d*).

When in the vertical position, 90° in relation to the ground, the handle (1) compresses at the maximum the flexible hose (6) in order to prevent the flow of the beverage. In this position the handle hole (9*bl*) are filled by the second metallic rod (9*c*) and the valve is locked so that the container containing the gasified liquid may be transported without the danger of leakage.

When the handle (1) is moved forward in relation to the user, the hose (6) will undergo a displacement that enables a minimal opening in its diameter so that the flow of the beverage is turbulent and the beverage is dispensed with enough foam.

When the handle (1) is moved backward in relation to the user, the compression of the flexible hose (6) is smaller and consequently the flow of the pressurized beverage is more laminar, allowing the liquid outlet with less quantity of foam.

In this sense, one of the purposes of this invention consists of the method for dispensing gasified liquid comprising the steps of:

i. Unlocking the handle (1);
ii. Positioning the cup or container in which the liquid will be dispensed at the end of the tubular extension (2);
iii. Moving the handle (1) forward or backward in relation to the user;
iv. Waiting for appropriate time; and
v. positioning the handle (1) in the 90° position.

The liquid pressurizing procedure involves the steps of:

i. placing the liquid to be gasified into a suitable container with the valve of this invention installed;
ii. connecting the cylinder hose (20) to the air valve (3) of the valve main body (7);
iii. opening the cylinder register (22) allowing the flow of gas from the cylinder (23) to the liquid;
iv. waiting for adequate time;
v. closing cylinder register (22); and disconnecting the cylinder hose (20) from the air valve (3).

The connection of the cylinder (23) to said valve occurs through a coupling similar to that used in the calibration of automobile tires. A cylinder hose (20) is coupled to the cylinder (23) through a screw system and the opposite end comprises a gas injection nozzle comprising a clamp (19) similar to that used in tire air minicompressors as the commercially available SH-P 00004 model. Said clamp (19) fits into the valve main body (7) according to this invention directly in a Schrader valve (3) which is a valve used in a tubeless automobile tire as the market model 414R.

Since the ends are properly connected, the cylinder register (22) is opened and the pressurization starts. The gasification may be done with carbon dioxide $CO_2$ (99.9%), nitrogen $N_2$ (99.9%), or a mixture thereof.

The gasification time and the final pressure reached indicated in the display (21) will depend on the volume of liquid to be gasified, the type of gas used, the temperature, the material of the container comprising the liquid and the user's interest. If the user desires a thick beer head, it may increase the content of the solubilized gas in the beverage.

In one embodiment, for a 2 L container being 70% filled with the beverage and therefore 30% hollow, the gasification was made at the pressure of 3.5 kgf $cm^{-2}$ of $CO_2$ for 2 seconds, so that the gas pressure (in kgf $cm^{-2}$)×volume of the hollow bottle (as percent of the total volume) is equal to or greater than 1 kgf $cm^{-2}$.

This gasification procedure may be done in both the commercial establishment and the home environment, following the proper safety requirements.

Once this step is finished, the cylinder (23) is closed, the hose clamp (19) is disconnected from the Schrader air valve (3) and the liquid is ready to be dispensed and consumed.

The use of the Schrader valve (3) allows for a high efficiency in the gasification process and the maintenance of the gasification, since it prevents escape of gas during storage and transport of the beverage over time.

Valve Main Body (7)

The valve main body (7) according to this invention is a single piece which may be plastic, metal or other compatible material.

Said valve main body (7) comprises a nozzle (11) whose inner wall comprises a universal thread (10) compatible with the thread of the container which stores the liquid (18). Said nozzle (11) further comprises a concentric cylindrical piece (11*a*) whose inner wall comprises a thread (11*b*) compatible with the reductant thread (14). The front portion of the valve main body (7) is provided with a tubular extension (2) for the outlet of the liquid, positioned at an angle of approximately 30° with respect to the valve main body (7).

At the other end of the valve main body (7), there is a projection of cylindrical shape, of diameter 5 mm and length 1 cm, for the insertion of the Schrader air valve (3), used for the pressurization and gasification of the liquid (18).

The valve main body (7) further comprises an inner channel (3*a*) that allows the passage of the gas of the Schrader air valve (3) into the container where the liquid (18) is stored.

On the right and left sides of the valve main body (7), there are two small overlapping holes (9*au*, 9*al*) of diameter 2 mm each, with 2 mm spacing from each other. The upper hole (9*au*) is used to hold the handle (1) against the valve main body (7) during handling, so as to allow for its movement. When lower hole (9*al*) is filled with the second metallic rod (9*c*), with the handle (1) at 90° position, the flexible hose (6) is fully compressed, and the valve is locked so that the beverage may be transported without danger of leakage. Both the grip of the handle (1) to the valve main body (7) of the valve and the full locking thereof are made by passing the second metallic rod (9*c*), by main body hole (9*al*) in the valve and handle hole (9*bl*).

In the core of the upper portion of the valve main body (7) there is a hollow portion of rectangular shape followed by a hollow semi-ball (8). The handle (1) is fitted in this hollow space and a flexible hose (6) is positioned in "L". One of the ends of said flexible hose (6) is in contact with the upper end of the pipe (5) and the other end open to the environment.

In one embodiment, said valve is compatible with a growler with the nozzle similar to that of a pet bottle.

In one embodiment, the main body (7) of said valve comprises an outer diameter 3.5 cm and height 3.0 cm, tubular extension of length 6 cm, diameter 4.25 mm, at an angle of approximately 30° with respect to the valve main body (7) and projecting from diameter 5 mm and length 1 cm, rectangular shaped hollow portion with 4.25 mm height and 4.96 mm long, hollow semi-ball (8) of 8 mm diameter, inner diameter of thread diameter 7.14 mm, two overlapping main body holes (9*au*, 9*al*) of diameter 2 mm with 2 mm spacing from each other.

In one embodiment, the cylindrical piece (11*a*) of the valve main body (7) comprises means for coupling the reductant (4) other than a thread.

Handle

The handle (1) according to this invention is a movable portion of said valve that enables the egress of the gasified liquid. The formation of the foam occurs according to the movement of the handle (1) which varies 60°.

Said handle (1) comprises a semi-ball (12) at one end through which the fitting is made in the valve main body (7) according to this invention which comprises a hollow semi-ball (8).

Said handle (1) comprises in the semi-ball two small holes (9*bu*, 9*bl*) which correspond to other two small holes (9*au*, 9*al*) in the valve main body (7). Such holes (9*au*, 9*bu*) are passed through a metallic rod (9*d*) which allows the handle (1) to move in a total opening of about 60° in the vertical direction.

In one embodiment, the handle (1) according to this invention comprises 46 mm long, 11.07 mm thick having 17.15 mm handle semi-ball (12) radius at one end, 2 mm diameter overlapping handle holes (9*bu*, 9*bl*) with 2 mm spacing and beveled edges throughout the piece.

Said handle (1) is locked when it is in the vertical position 90° in relation to the ground (FIG. 9A) and with the handle hole (9*al*) passed through by a second metallic rod (9*c*). In this way, the container may be shipped without any danger of leakage of the liquid (18).

When said handle (1) is moved forward in relation to the user (FIG. 9B), it allows the flow of the gasified liquid with high turbulence as in this position it has a high compression level of the flexible hose (6) that is with the inner diameter well reduced.

When the handle (1) is moved backward in relation to the user (FIG. 9C), it allows the flow of the gasified liquid (18) with low turbulence as in this position it has a low compression level of the flexible hose (6), which then presents with increased or completely free inner diameter.

Flexible Hose at "L"

The flexible hose (6) according to this invention is a hose positioned at "L" in the main body (7) of the valve. Such "L" position is due to the fact that one of its ends is connected to the upper end of the outlet pipe (5) and the other end fitted to the tubular extension (2) of the valve main body (7) for dispensing the liquid (18).

The folding of said "L" occurs by passage of said flexible hose (6) by the hollow semi-ball (8) of the valve body 7. Said flexible hose (6) is positioned between the hollow semi-ball (8) of the valve main body (7) and the handle semi-ball (12) of the end of the handle (1). Thus, during movement of the handle (1), the inner diameter of said flexible hose (6) is necessarily changed, reflecting directly in the manner as the gasified liquid (18) is dispensed.

In one embodiment, said flexible hose (6) is a silicone hose.

In one embodiment, said valve comprises a long "L" flexible hose (6) that is partially submerged in the liquid (18) and said valve does not comprise the liquid outlet pipe (5).

Liquid Outlet Pipe

The valve according to this invention comprises a liquid outlet pipe (5) that remains partially immersed in the gasified liquid (18).

In particular, such an outlet pipe (5) must be sufficiently stiff to withstand the external pressure of the gas dissolved in the liquid (18) but flexible enough to allow for the engagement of the reductants (4), (41).

In one embodiment, said outlet pipe (5) is of silicone of outer diameter 8 mm, inner diameter 5 mm and length 30 cm.

Reductants

The use of reductants (4), (41) along the liquid outlet pipe (5) allows for a more accurate control of the outflow of the beverage so as to decrease its turbulence during dispensing. Such reductants (4), (41) allow the valve to actuate in more fine and accurate manner in the customization of the creaminess of the beverage, i.e., in the formation of the foam.

The reductants (4, 41) according to this invention are devices that serve as a function to reduce the pressure of the solubilized gas in the liquid (18) as it passes through the pipe at the time the beverage is taken to leave the less turbulent outflow. Such reductants (4), (41) may have various shapes and be made of different materials and may or may not be of the same shape.

The valve according to this invention comprises an upper reductant (4) positioned at the upper end of the liquid outlet pipe (5), so as not only to allow for the reduction of the turbulence of the liquid flow, but also to allow the connection of the liquid outlet pipe (5) to the valve main body (7) according to this invention through an outer reductant thread (14).

Optionally, the valve according to this invention comprises a lower reductant (41) at the lower end of the liquid outlet pipe (5).

The reductant (4) comprises a rubber ring (16) which assists in the fitting of this liquid outlet pipe (5), preventing its movement with the use of the valve according to this invention.

Said reductant (4) comprises an outer thread (14) for fixation to the liquid outlet pipe (5) and the valve main body (7), and said reductant thread (14) comprises grooves (15) which assist in threading the valve main body (7).

The reductant (4) further comprises an upper cylindrical piece (4*a*) in which is connected the flexible hose (6) and a lower cylindrical piece (4*b*) in which the liquid outlet pipe (5) is fixed by means of a simple fitting.

In one embodiment, the upper and lower cylindrical piece (4*a*) (4*b*) of the reductant (4) has the same diameter.

In one embodiment, the lower and upper cylindrical piece (4*a*) (4*b*) has different diameters.

The reductant (4) further comprises a rubber ring (16) for sealing.

Figure 7:
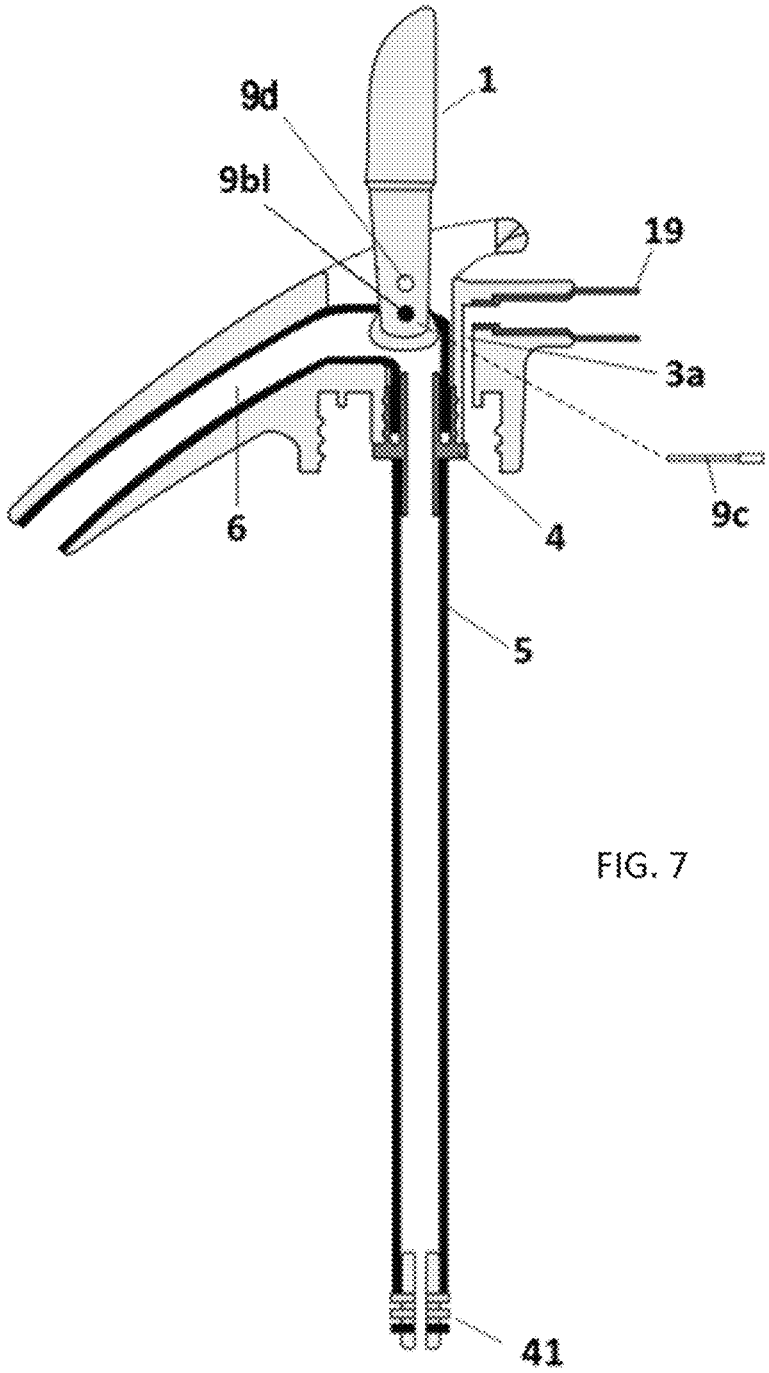
FIG. 7 shows a cross-sectional view of the valve according to this invention with the reductant connected to the nozzle of the valve body and the clamp of the cylinder hose connected to the air valve.

In one embodiment, the valve according to this invention comprises two reductants (4) (41), both of inner diameter 1 mm and length 2 cm both made of metallic material, as shown in FIG. 7.

In one embodiment, the valve according to this invention has only one reductant (41) and a long "L" flexible hose (6), wherein such a reductant (41) is positioned at the immersed end in the liquid (18).

EXAMPLE OF EMBODIMENT

The example of use to be described relates to the use of a 2 l capacity bottle which has been filled with 1.3 l of the beverage, for example chopp, at the usual temperature of consumption.

Once the bottle is filled, the valve was threaded, and the preparation is made for the pressurization of the beverage gasifying system. The FIG. 3A illustrates the threaded bottom portion of the valve, the nozzle.

For the gasification and pressurization, it is necessary to connect the cylinder (23), $CO_2$ or $N_2$, to the bottle. To this end, a cylinder hose (20) is used, for example polypropylene (5 mm diameter), wherein one of the ends has a thread coupled to the cylinder (23) and the other is a clamp (19) with an air injector nozzle as used in mini-air compressors for tire, commercially available model SH-P 00004.

Figure 8:
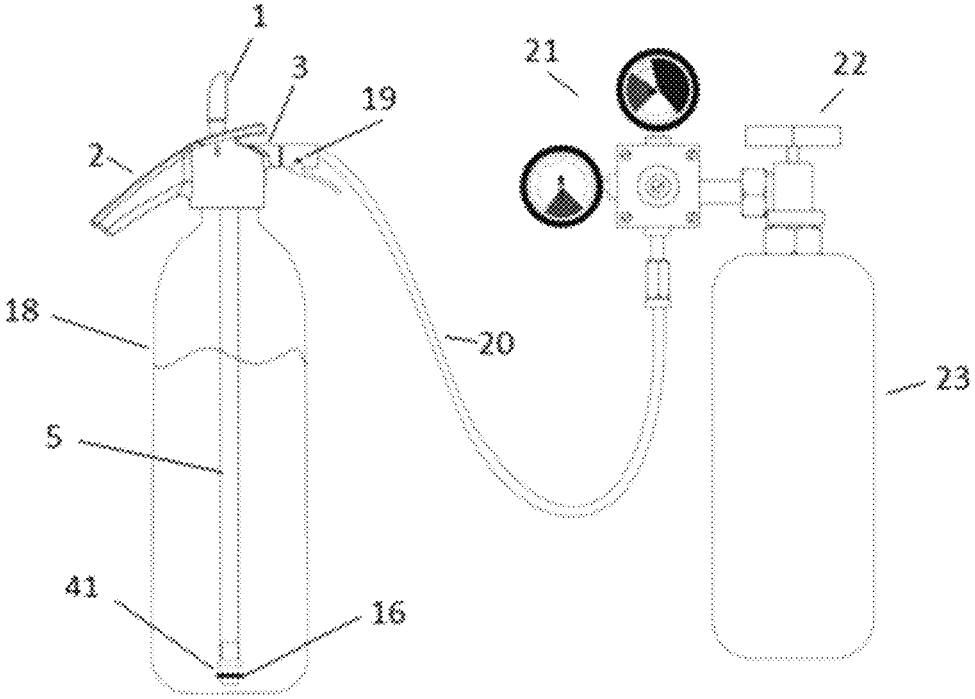
FIG. 8 shows the valve according to this invention positioned in the nozzle of the bottle containing the liquid connected to the hose of the gas cylinder (by the Schrader air valve, and the clamp of the hose as well as the gas cylinder registry which allows, when opened, the gas flow, and the pressure gauge.

The nozzle is coupled to the valve main body (7), which comprises a Schrader air valve (3), which is used in a tubeless automobile tire, the market Model 414R, as shown in FIGS. 7 and 8.

Since the ends are properly connected, the cylinder register (22) is opened and the pressurization starts. The gasification may be done with carbon dioxide $CO_2$ (99.9%), nitrogen $N_2$ (99.9%) or a mixture thereof. The recommended pressure is 3.5 kgf $cm^{-2}$ for 2 seconds. This procedure may be done in both the commercial establishment and the home environment, following the proper safety requirements. Once this step is finished, the cylinder register (22) is closed, the nozzle is disconnected from the bottle and dispensing of the beverage may be initiated.

For dispensing the beverage, the handle (1) of the valve according to this invention is used, in order to customize the quantity of foam of the beverage.

Figure 9A:
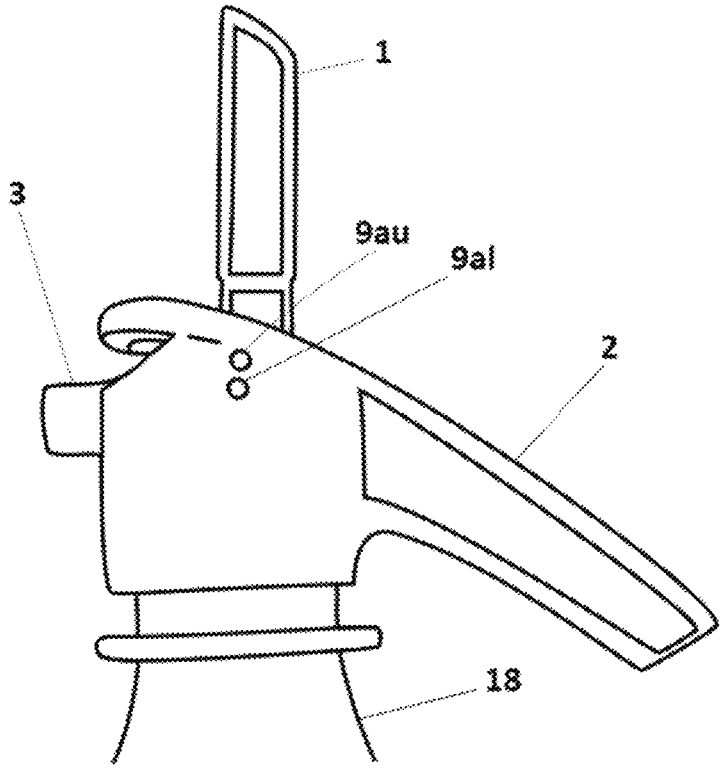
FIG. 9A shows the vertical position of the handle locking the operation of the valve.

When in the center position, FIG. 9A, the handle (1) is locked since it exerts maximum compression on the flexible hose (6), so that no liquid flows.

Figure 9B:
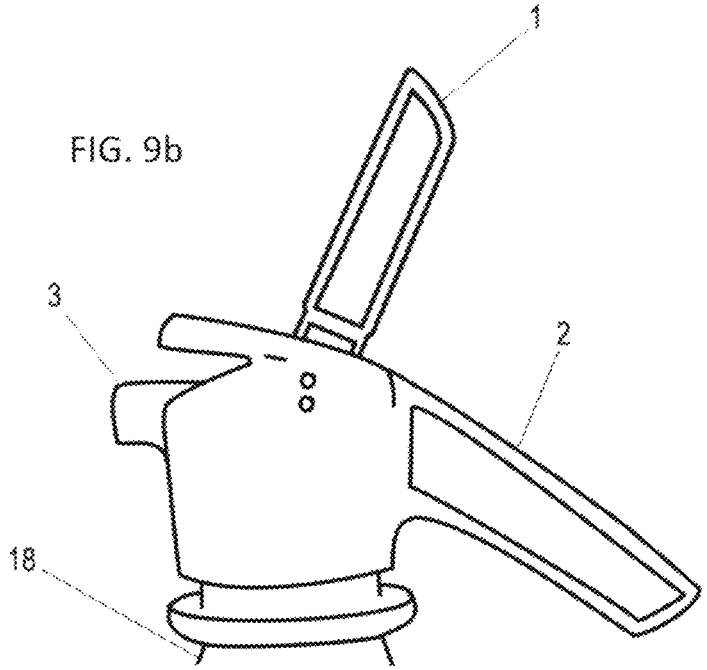
FIG. 9B shows the position forward in relation to the user allowing the dispensing of the beverage with the formation of a large quantity of foam.
Figure 9C:
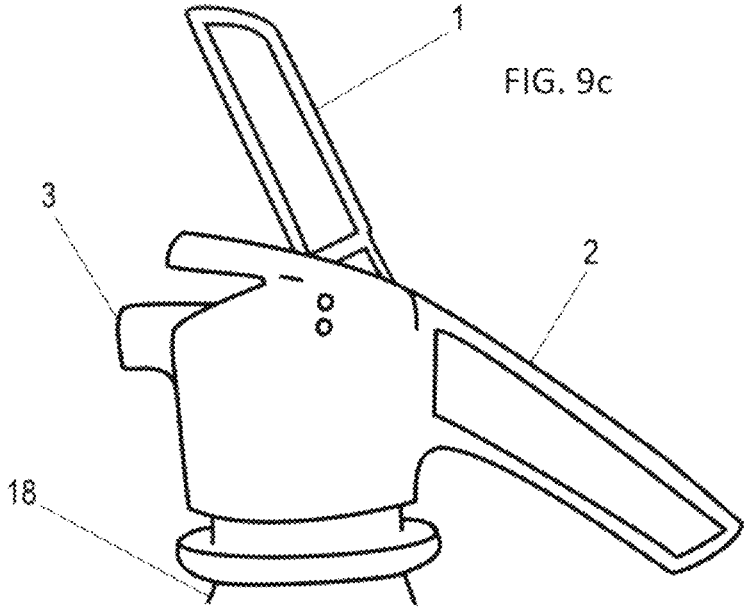
FIG. 9C shows the position backward in relation to the user allowing the dispensing of the beverage with small foaming.

When the handle (1) is moved forward in relation to the user, FIG. 9B, the flexible hose (6) undergoes a modification in its compression that enables a minimal opening of the inner diameter thereof, so that the flow of the beverage is turbulent, enabling the output of large quantity of foam.

When the handle (1) is moved backward in relation to the user (FIG. 9C) the compression of the flexible hose (6) will be in its less compressed embodiment, i.e., more open, so that the flow of the pressurized beverage is more laminar, allowing the liquid to exit, with less quantity of foam.

The invention claimed is:

1. A valve for gasifying and dispensing gasified liquids consisting of a main body encompassing a Schrader air valve interconnected to an inner channel; said valve main body further containing a nozzle including a universal thread; a flexible hose in an "L" shape positioned internally of a tubular extension, wherein said flexible hose is arranged between the valve main body and a handle which pivots with reference to the valve main body through a metallic rod that passes through a handle upper hole and main body upper hole; said valve main body comprises a cylindrical piece having a threaded inner which connects to an outer thread of an upper reductant; and the upper reductant connects to a liquid outlet pipe, said upper reductant connects to said flexible hose; and a lower reductant connects to the end of said liquid outlet pipe.

2. The valve according to claim 1, containing a locking mechanism, wherein a second metallic rods of the locking mechanism passes through a handle lower hole and a main body lower hole with the handle in a 90° position.

3. The valve according to claim 1, wherein the handle comprises a semi-ball in a lower region.

4. The valve according to claim 3, wherein the valve main body comprises a hollow semi-ball compatible with the handle semi ball.

5. The valve according to claim 1, wherein the air valve is a tubeless car tire valve.

6. The valve according to claim 1, wherein the upper reductant comprises an outer thread with grooves; the upper reductant still comprises a lower cylindrical piece and an upper cylindrical piece.

* * * * *